United States Patent [19]

Asari et al.

[11] 4,251,202

[45] Feb. 17, 1981

[54] MOLDING DIE STEM WITH SLEEVE

[75] Inventors: Akira Asari, Osaka; Tatsuhiko Noyori; Takahisa Tabuchi, both of Kobe; Tetsuro Takehata, Osaka, all of Japan

[73] Assignee: Kobe Steel, Limited, Kobe, Japan

[21] Appl. No.: 946,327

[22] Filed: Sep. 27, 1978

[30] Foreign Application Priority Data

Oct. 19, 1977 [JP] Japan ..... 52/141616[U]

[51] Int. Cl.[3] ..... B29F 3/04

[52] U.S. Cl. ..... 425/461; 285/55; 425/376 R; 425/567

[58] Field of Search ..... 425/568, 376 R, 568, 425/461, 567, 571, DIG. 227; 285/55

[56] References Cited

U.S. PATENT DOCUMENTS

| | | | |
|---|---|---|---|
| 1,702,619 | 2/1929 | Sargent | 285/55 |
| 2,462,308 | 2/1949 | Dinzl | 425/568 |
| 2,529,146 | 11/1950 | Feitl | 425/568 |
| 2,533,885 | 12/1950 | Hill | 285/92 |
| 2,747,226 | 5/1956 | Schnitzius et al. | 425/568 |
| 2,754,545 | 7/1960 | Hendry | 425/376 R |
| 2,973,551 | 3/1961 | Arslanian | 425/461 |
| 3,232,638 | 2/1966 | Hollander | 285/55 |
| 3,698,640 | 10/1972 | Stanciu | 425/568 |
| 3,913,949 | 10/1975 | Senatro | 285/55 |
| 3,934,626 | 1/1976 | Hall | 425/568 |

*Primary Examiner*—John C. Bleutge
*Assistant Examiner*—A. H. Koeckert
*Attorney, Agent, or Firm*—Oblon, Fisher, Spivak, McClelland & Maier

[57] ABSTRACT

A die stem for an extrusion press connected at its one end to a die holder including a first connecting construction such as a screw or a bayonet provided in the inner bore of the end portion of a sleeve received by the inner bore of the die stem, and a second connecting construction such as a screw or a bayonet provided at the rear end projection of the die holder, the second connecting construction being adapted to cooperate with the first connecting construction, whereby the compression stress at the connecting portion thereof due to the extrusion force is prevented from taking place.

4 Claims, 3 Drawing Figures

MOLDING DIE STEM WITH SLEEVE

BACKGROUND OF THE INVENTION

Field of the Invention

This invention relates to a die stem for use in an extrusion press, and particularly to a sleeve type die stem.

Description of the Prior Art

In the die stem of a type adapted to be connected at its end to a die holder incorporating a die or a die backer, such as a die stem for use in an indirect extrusion press, a compression force is generated in the connecting construction during the extrusion so as to shorten the life of the die stem, thus hindering the safe operation of the whole apparatus.

As is well known, in the indirect extrusion press, it is a common practice to use a die stem unitarily connected at its end to a die holder, through a connecting construction such as a screw or a bayonet, to a die holder incorporating a die, die backer and so forth. In such a die stem, however, the stress concentration factor is impractically large. In fact, this factor is as large as on the order of 2 to 3 or larger. During the extrusion, the full extrusion power is concentrated on the die stem and the die holder, so that the resulting compression stress attains a considerably high level. Consequently, the life of the conventional die stem is rendered impractically short, so as to jeopardize the safe operation of the whole apparatus.

FIGS. 1 and 2 show typical examples of conventional die stems. More specifically, FIG. 1. shows a die stem of a type having no sleeve. In this die stem, as will be seen from the illustration thereof, the die stem 3 is held by a die stem slide 1 through a die stem retainer 2 or the like. In such illustrated example, a thread 3*b* is formed at the end portion of the internal bore 3*a* of the die stem 3. On the other hand, a thread 6*b* adapted to engage the thread 3*b* is formed on the outer periphery of a rear end projection 6*a* of a die holder 6 incorporating a die 4 and a die backer 5. In use, the die stem 3 and the die holder 6 are made unitary, through the screwing engagement of both threads 3*a*, 6*b*. In this state, the front end of the die stem 3 and the rear end of the die holder 6 are held in contact with each other, as shown in FIG. 1.

FIG. 2 shows another example of a conventional die stem, in which a sleeve is incorporated. In this type of the die stem, an inner sleever 7 is received by an inner bore 3*a* of the die stem 3 which is held by the die stem slide 1 through the medium of a die stem retainer 2 or the like. The sleeve 7 is fixed at its rear end to the rear end of the die stem 3 by means of a nut 8 or like means. The inner sleeve 7 is provided at its end with an outer peripheral thread 7*a*, while the rear end projection 6*a* of a die holder 6 incorporating a die 4 and a die backer 5 is provided with an inner peripheral thread 6*b* adapted for engagement with the thread 7*a* of the inner sleeve. In use, the die stem 3 and the die holder 6 are fixed unitarily to each other, through the medium of the inner sleeve 7, by screwing engagement. In this type of the die stem, the die stem 3 is made to contact at its front end surface the rear end surface of the rear end projection 6*a* of the die holder 6.

As the extrusion power is exerted as shown by the arrow F in the extrusion stroke of the extrusion press, a large nominal compression stress is generated at the thread 3*b* of the die stem 3 in case of the arrangement as shown in FIG. 1, and at the thread 6*b* of the die holder 6 in case of the arrangement as shown in FIG. 2. Further, due to the stress concentration at the bottom of the thread, a stress 2 to 3 times as large as the nominal compression stress is generated at the thread and the bottom of the teeth. This large stress often causes a local plastic deformation at the bottom of the screw, resulting in a shortened life of the die stem. Alternatively, in order to avoid such an inconvenience through reducing the level of the nominal compression stress, it is necessary to reduce the inner diameter of the die holder 6. Although the connecting constructions in these examples are screws, the same disadvantages are caused in the die stem having a connecting construction constituted by bayonets.

SUMMARY OF THE INVENTION

The present invention has been made to overcome the above mentioned shortcomings of the prior art, and the object of the invention is to provide a die stem of long life so as to save cost due to the repeated replacement and repair of parts.

Another object of the invention is to provide a die stem to secure a safe operation of an extrusion press apparatus.

The above and the other objects of the invention are achieved by the following aspects of the invention. The first embodiment of the invention is directed to a die stem for extrusion press connected at its one end to a die holder, which comprises a first connecting means provided in the inner bore of the end portion of a sleeve received by the inner bore of the die stem, and a second connecting means provided at the rear end projection of the die holder, the second connecting means being adapted to cooperate with the first connecting means.

In the die stem of the invention as shown in the drawings, the first and second connecting means comprises a screw, although the first and second connecting means may comprise a bayonet (not shown).

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
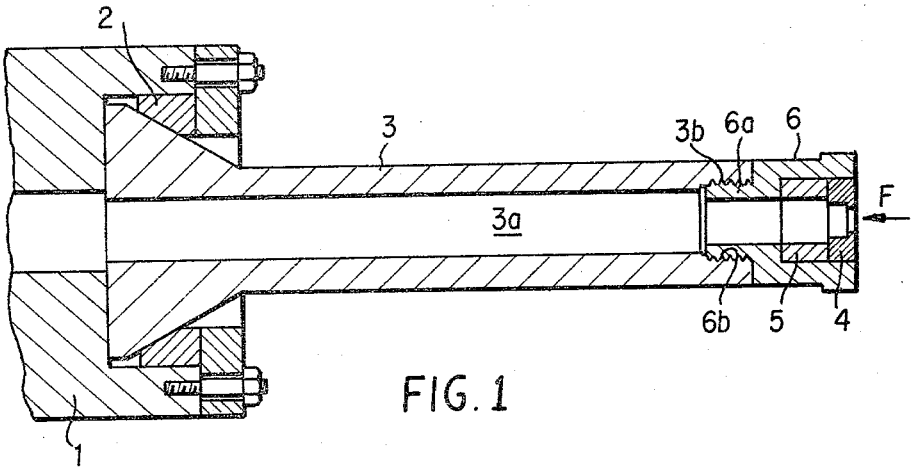
FIG. 1 is a sectional side elevational view of a typical example of conventional die stem.
Figure 2:
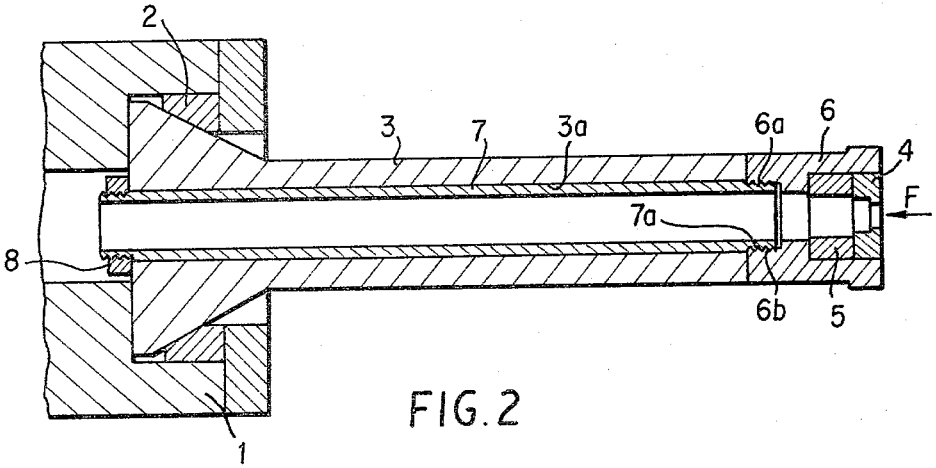
FIG. 2 is a sectional side elevational view of another example of a conventional die stem.
Figure 3:
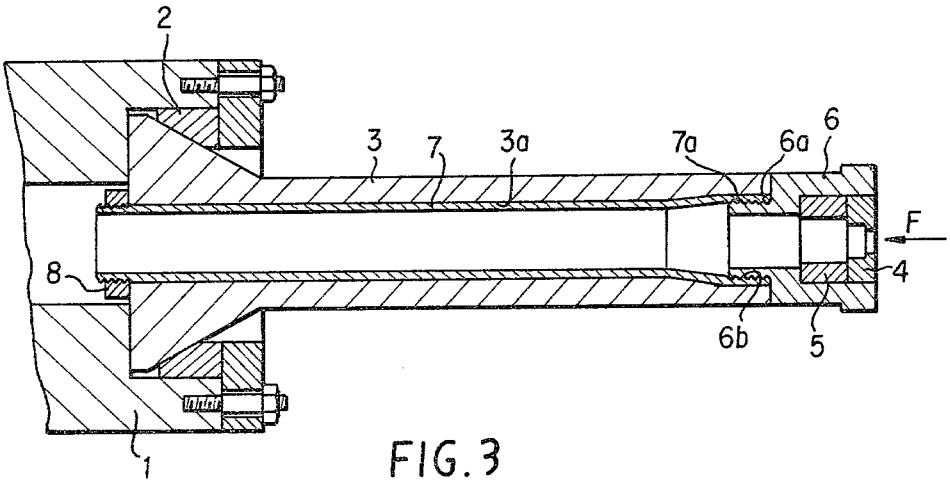
FIG. 3 is a sectional side elevational view of an embodiment of the invention.

Hereinafter, the invention will be described through an embodiment with reference to the FIGURES. FIG. 3 shows a practical embodiment of the invention. A die stem 3 is carried by a die stem slide 1 through a die stem retainer 2 or the like, as in a conventional die stem. The die stem 3 has an inner bore 3*a* receiving an inner sleeve 7. The inner sleeve 7 is fixed at its rear end to the die stem 3 by means of a nut 8 or the like means. The length of the inner sleeve 7 is so selected as not to project from the end of the die stem 3. In the illustrated embodiment, a thread 7*a* is formed on the inner peripheral surface of the inner sleeve 7, so as to constitute a first connecting construction. An equivalent effect can be obtained when the thread 7 is substituted by bayonet to constitute a second type of connecting construction. On the other hand, a die holder 6 incorporating a die 4 and a die backer 5 is provided at its rear end portion with a rear end projection 6*a* adapted to be received by the end portion of the bore of the sleeve 7. The rear end projection 6*a* is provided with a thread 6*b* formed on the outer periphery thereof and adapted for making a screwing engagement with the aforementioned thread 7*a*. Thus, the die stem 5 and the die holder 6 are adapted to be connected unitarily to each other by the screwing engagement of the threads 7*a* and 6*b*.

It will be seen that, in the described embodiments, the connecting construction constituted by the thread or the bayonet is provided at the inner side of the juncture surfaces of the die stem 3 and the die holder 6, so that the full extrusion power exerted in the direction of the arrow F on the die holder 6 and the die stem 3 is not applied to the connecting portion 7*a*, 6*b* constituted by the threads.

Consequently, it does not become necessary to take into consideration the stress concentration which has had to be taken into account in the conventional arrangements described hereinabove. It is therefore possible to select and adopt an allowable stress large enough to approach the yielding point of the material. This in turn allows adoption of a large inner diameter of the die stem. Needless to say, the life thereof is thus prolonged to reduce the cost and to enhance safety.

Thus, the present invention provides an improved sleeve type die stem suitable for use in indirect extrusion press.

Obviously, new modifications and variations in the present invention are possible in light of the above teachings. It is therefore to be understood that within the scope of the appended claims the invention may be practiced otherwise than as specifically described herein.

What is claimed as new and desired to be secured by Letters patent of the United States is:

1. A die stem assembly for an extrusion press, comprising:

a elongate die stem having an axial bore therethrough and having a flat end surface at one end thereof, the bore being radially enlarged at said one end;

an elongate sleeve fitted in the die stem bore, and having one end radially enlarged complementally to the die stem bore;

a die holder having a flat, annular shoulder in abutting engagement with the die stem end surface and having an axial projection extending into said one end of the sleeve;

first connecting means engaged between the outer surface of the die holder projection and the inner surface of said one end of the sleeve; and second connecting means engaged between the other end of the sleeve and die stem, holding the die holder and die stem together via the sleeve and connecting means, whereby axial compressive forces on said one end of the die holder and die stem are carried by the axially abutting shoulder and end surface and the connecting means remain substantially free of deforming stresses.

2. The die stem assembly of claim 1, wherein the first and second connecting means comprise a threaded portion.

3. A die stem assembly as claimed in claim 2, wherein:

said one end of said sleeve has threads on the inner surface thereof;

the outer surface of the die holder projection has threads thereon for cooperation with the sleeve threads, and with the sleeve threads comprises the first connecting means; and the other end of the sleeve projects beyond the other end of the die stem and has a nut threaded thereon, comprising the second connecting means, whereby the sleeve and first and second connecting means serve merely to hold the die holder to the die stem, and axial compressive forces produced during extrusion are carried by the abutting shoulder and end surface.

4. The die stem assembly of claim 1 which further comprises:

a die mounted in said die holder; and a die backer disposed within said die holder adjacent said die.

* * * * *